US009811054B2

(12) United States Patent
Bertrand et al.

(10) Patent No.: US 9,811,054 B2
(45) Date of Patent: Nov. 7, 2017

(54) SYSTEM FOR SECURING A BALANCE SPRING

(71) Applicant: ROLEX SA, Geneva (CH)

(72) Inventors: Jean-Louis Bertrand, Feigères (FR); Pascal Billet, Morbier (FR)

(73) Assignee: ROLEX SA, Geneva (CH)

( * ) Notice: Subject to any disclaimer, the term of this patent is extended or adjusted under 35 U.S.C. 154(b) by 0 days.

(21) Appl. No.: 14/952,414

(22) Filed: Nov. 25, 2015

(65) Prior Publication Data

US 2016/0154379 A1 Jun. 2, 2016

(30) Foreign Application Priority Data

Nov. 27, 2014 (EP) ..... 14195264

(51) Int. Cl.

| | |
|---|---|
| ***G04B 17/06*** | (2006.01) |
| ***G04B 18/02*** | (2006.01) |
| ***G04B 17/32*** | (2006.01) |
| ***G04D 7/10*** | (2006.01) |
| ***G04B 18/06*** | (2006.01) |

(52) U.S. Cl.

CPC ..... *G04B 17/063* (2013.01); *G04B 17/325* (2013.01); *G04B 18/02* (2013.01); *G04B 18/06* (2013.01); *G04D 7/10* (2013.01)

(58) Field of Classification Search

CPC .... G04B 17/325; G04B 18/06; G04B 17/063; G04B 18/02; G04F 7/10; G04D 7/10

USPC ..... 368/178

See application file for complete search history.

(56) References Cited

U.S. PATENT DOCUMENTS

| | | | | |
|---|---|---|---|---|
| 273,138 A * | 2/1883 | Oldroyd | G04B 18/06 368/176 |
| 1,181,510 A | 5/1916 | Eberhard et al. | |
| 2,782,591 A | 2/1957 | Guida et al. | |
| 3,154,912 A * | 11/1964 | Pinkas | G04B 17/325 368/170 |
| 3,262,261 A * | 7/1966 | Monnin | G04B 17/325 368/178 |
| 5,907,524 A * | 5/1999 | Marmy | G04B 17/066 368/175 |
| 7,237,945 B2 * | 7/2007 | Geyer | G04B 18/02 368/175 |

(Continued)

FOREIGN PATENT DOCUMENTS

| | | |
|---|---|---|
| CH | 700 408 A2 | 8/2010 |
| CH | 700 653 A2 | 9/2010 |

(Continued)

OTHER PUBLICATIONS

Translation CH 700408—epo.org—Aug. 7, 2016.*

(Continued)

*Primary Examiner* — Sean Kayes

(74) *Attorney, Agent, or Firm* — Westerman, Hattori, Daniels & Adrian, LLP

(57) ABSTRACT

A balance spring system of a horology movement, comprising:

- a balance spring (1);
- a movement blank;
- a first element (1*c*) for indexing the position of an outer end (10) of the balance spring relative to the blank; and
- a unit (OL) for connection of the outer end (10) of the balance spring to the movement blank, the first indexing element (1*c*) being designed such as to be displaceable relative to the connection unit (OL).

21 Claims, 5 Drawing Sheets

(56) References Cited

U.S. PATENT DOCUMENTS

| | | | | |
|---|---|---|---|---|
| 8,297,833 | B2 * | 10/2012 | Schmiedchen ..... | G04B 18/023 368/170 |
| 2006/0062088 | A1 | 3/2006 | Hintze et al. | |
| 2012/0082010 | A1 | 4/2012 | Boulenguiez et al. | |
| 2013/0051190 | A1 | 2/2013 | Villar et al. | |
| 2014/0112110 | A1 | 4/2014 | Villar et al. | |
| 2014/0286143 | A1 | 9/2014 | Stranczl et al. | |
| 2014/0328150 | A1 | 11/2014 | Boulenguiez et al. | |
| 2015/0234355 | A1 * | 8/2015 | Cabezas ..... | G04B 17/066 368/178 |

FOREIGN PATENT DOCUMENTS

| | | | |
|---|---|---|---|
| CH | 704 316 | A2 | 7/2012 |
| CH | 705605 | A2 | 4/2013 |
| DE | 20 2010 014 253 | U1 | 3/2011 |
| EP | 1 437 634 | A1 | 7/2004 |
| EP | 1798609 | A2 | 6/2007 |
| EP | 2437126 | A1 | 4/2012 |
| EP | 2565730 | A1 | 3/2013 |
| EP | 2570868 | A1 | 3/2013 |
| EP | 2781970 | A1 | 9/2014 |
| EP | 2799937 | A1 | 11/2014 |
| FR | 1293095 | A | 5/1962 |

OTHER PUBLICATIONS

European Search Report dated Sep. 3, 2015 issued in corresponding application No. EP14195264; w/partial English translation and partial English machine translation (12 pages).

European Search Report and Written Opinion dated May 12, 2016 issued in corresponding application No. EP15196169; with English partial translation and partial machine translation (18 pages) (CH700408 cited in the European Search Report is not listed in this IDS since it was previously listed in the IDS filed on Nov. 25, 2015).

* cited by examiner

SYSTEM FOR SECURING A BALANCE SPRING

The invention relates to a balance spring system for a horology movement. It also relates to a horology movement including a system of this type. It also relates to a horology piece, in particular a wristwatch, comprising a system of this type or a movement of this type. Finally, it relates to a method for putting a movement of this type into beat.

A balance spring oscillator is conventionally fitted in a horology movement by means of interposition of a series of parts prearranged on the balance bridge, which are designed to permit its rotation, and thus allow easy adjusting of the escapement, such that at the dead point, or balance position, the center of the balance plate pin is on the line which connects the pivotings of the pallets, or of the blocking lever, and of the balance. For this purpose, the outer end of the balance spring is usually secured on the balance bridge by means of a securing support, for example a stud support, which can be rotated relative to the frame of the horology movement. Dismantling of this unit for angular positioning of the balance bridge induces loss of adjustment of the adjusting-mark.

Patent application EP1798609A2 discloses a conventional stud support on which the outer end of a spring is secured. This stud support is assembled on a balance bridge. More particularly, it is pivoted with friction on the balance bridge by means of the interposition of resilient means, which are designed to cooperate with a guide portion of the balance bridge. Connected elements such as a micrometric screw and a return spring make it possible to adjust the rotation of the stud support finely relative to the balance bridge. The adjusting operation is thus carried out conventionally by fine rotation of the spring securing support relative to the frame of the horology movement. Dismantling of the stud support from the balance bridge also induces loss of adjustment of the adjusting-mark.

Patent application EP2437126A1 describes a spring, the outer end of which is produced integrally with a connection unit which is designed to be secured on an angular positioning unit of a balance bridge. More particularly, this positioning unit is guided in rotation on the balance bridge by means of interposition of a bore which is designed to cooperate with a cylindrical portion of the bridge. Dismantling of this unit from the balance bridge in this case induces loss of adjustment of the adjusting-mark. According to an alternative embodiment, the balance spring can be displaced relative to the balance bridge independently of an angular positioning unit. In this case, the adjusting-mark can be adjusted by modifying the angular position of the spring directly, in particular by interposition of the connection unit of the balance spring. Dismantling of the oscillator from the balance bridge in this case induces loss of adjustment of the adjusting-mark.

Application EP2799937A1 describes a unit for angular positioning of a balance spring which is integral with a shock absorber body. Thus, the adjusting operation is carried out by the angular displacement of the shock absorber body, in particular by means of a specific drive area of the shock absorber body, which for example can be in the form of toothing or flattened parts. Dismantling of the oscillator from the balance bridge induces loss of adjustment of the adjusting-mark.

Patent application EP2570868A1 describes an oscillator which is formed and designed such as to eliminate any adjusting operation. A spring, a large plate, a plate pin, as well as a small plate are produced in a single piece, such that the angular indexing of these elements a priori does not require further adjustment of the oscillator once it has been fitted in the movement. The outer end of the spring can thus be rendered integral with a fixed part of the movement, for example the plate, the pallet bridge, or the balance bridge. The stud of the outer end of the balance spring can in particular be designed to be inserted in a hole in the plate, and to be retained axially by a small plate added onto the plate. This document does not disclose any means for adjustment of the angular position of the spring, and in particular of the stud, relative to the frame of the movement.

Document EP2565730A1 relates to an escapement support module which is intended to pivot the components of the adjustment unit, which is designed to be added directly onto the plate of the movement. It is distinguished in that all the components of the adjustment unit are arranged so as to be able to be assembled in an automated manner from a single side of the module. This device is without a regulator assembly, or any device making it possible to adjust the position of the outer end of the balance spring mechanically; the end of this spring is presumably glued or welded onto a surface for receipt of the lower bridge of the module. No relevant element concerning the adjustment of the oscillator is apparent from this application.

In all the documents known in the prior art which disclose a balance spring which is designed to be displaceable relative to the blank on which it is fitted, it is necessary to carry out operations of regulation of the oscillator, in particular adjusting operation, when the oscillator is fitted in the movement. This can prolong the operations of assembly of the movement and/or make them more complex.

The objective of the invention is to provide a balance spring system for a horology movement which makes it possible to eliminate the above-described disadvantages, and to improve the systems known in the prior art. In particular, the invention proposes a system which makes it possible to simplify the operations of fitting and refitting of the oscillator of a mechanical horology movement.

A system according to the invention is defined by point 1 as follows:

1. A balance spring system of a horology movement, comprising:
   - a balance spring;
   - a movement blank;
   - a first element for indexing the position, in particular the angular position, of an outer end of the balance spring relative to the blank, in particular a first indexing element which is designed to cooperate with a second indexing element provided on the blank; and
   - a unit for connection of the outer end of the balance spring to the movement blank, the first indexing element being designed such as to be displaceable, in particular displaceable in rotation, relative to the connection unit.

Different embodiments of the system are defined by points 2 to 14 as follows:

2. The system as defined in the preceding point, wherein the connection unit is at a median plane of the balance spring, in particular the connection unit is between a first plane and a second plane, the first plane and the second plane being symmetrical relative to the median plane, and spaced by a distance which is smaller than 1.2 mm, or smaller than 1 mm, or smaller than 0.8 mm.
3. The system as defined in one of the preceding points, wherein the first indexing element comprises a shaft which is fitted on the connection unit, in particular a screw foot which is fitted on the connection unit, the connection unit being designed to cooperate with a bore provided in the blank.

4. The system as defined in one of the preceding points, wherein it comprises a first element for immobilization of the connection unit relative to the first indexing element, in particular a screw which is designed to cooperate with the screw foot.
5. The system as defined in one of the preceding points, wherein it comprises a first element for guiding of the first indexing element, in particular an oblong cut-out which is designed to cooperate with a second guiding element, particularly with a complementary geometry, in particular a flattened part of the screw foot.
6. The system as defined in one of the preceding points, wherein it comprises a first element for adjustment of the position of the outer end of the balance spring relative to the blank, in particular a toothed adjustment sector which is designed to cooperate with a second adjustment element, in particular a toothed nut which is fitted such as to be mobile in rotation on the blank.
7. The system as defined in the preceding point, wherein a friction element, in particular a spring, particularly a spring blade, is designed to cooperate directly or indirectly with the second adjustment element, such as to create friction torque which opposes the rotation of the second adjustment element.
8. The system as defined in one of the preceding points, wherein it comprises a third element for guiding of the system in rotation relative to the blank, in particular a groove or a pin which is designed to cooperate with a fourth guiding element provided on the blank, in particular a pin or a groove.
9. The system as defined in one of the preceding points, wherein it comprises a second element, in particular an immobilization surface, for immobilization of the connection unit relative to the blank or of the outer end of the balance spring relative to the blank, in particular a second immobilization element, particularly an immobilization surface, which is designed to cooperate with at least a third immobilization element, particularly an immobilization surface, of the blank.
10. The system as defined in one of the preceding points, wherein it comprises a first adjusting-mark for the position of the outer end of the balance spring relative to the blank, in particular first toothing or a first adjusting-mark which is designed to cooperate respectively with a second adjusting-mark provided on the blank or second toothing provided on the blank.
11. The system as defined in one of the preceding points, wherein the blank is a plate.
12. The system as defined in one of the preceding points, wherein the connection unit is produced integrally with the outer end of the balance spring or is in a single piece with the balance spring.
13. The system as defined in one of points 1 to 11, wherein the connection unit comprises a first body and a second body produced integrally with the outer end of the balance spring or in a single piece with the balance spring, the first body being permanently secured on the second body, in particular by at least one connection element, or produced integrally with the second body.
14. The system as defined in the preceding point, wherein the interface between the first body and the second body is at a median plane of the balance spring, in particular the interface between the first body and the second body is between a first plane and a second plane, the first plane and the second plane being symmetrical relative to the median plane, and spaced by a distance which is smaller than 1.2 mm, or smaller than 1 mm, or smaller than 0.8 mm.

A movement according to the invention is defined by point 15 as follows:

15. A horology movement comprising a system as defined in one of the preceding points.

An embodiment of the movement is defined by point 16 as follows:

16. The horology movement as defined in the preceding point, wherein the movement comprises a movement blank, notably a plate, and a balance, the balance spring system being placed between the balance and the movement blank.

A horology piece according to the invention is defined by point 17 as follows:

17. A horology piece, in particular a wristwatch, comprising a system as defined in one of points 1 to 14, or a movement as defined in point 15 or 16.

A method for putting a movement into beat according to the invention is defined by point 18 as follows:

18. A method for putting a horology movement as defined in point 15 or 16 into beat, wherein it comprises the following steps:
    - releasing the first indexing element relative to the connection unit
    - displacing the connection unit and
    - securing the position of the first indexing element relative to the connection unit.

Figure 1:
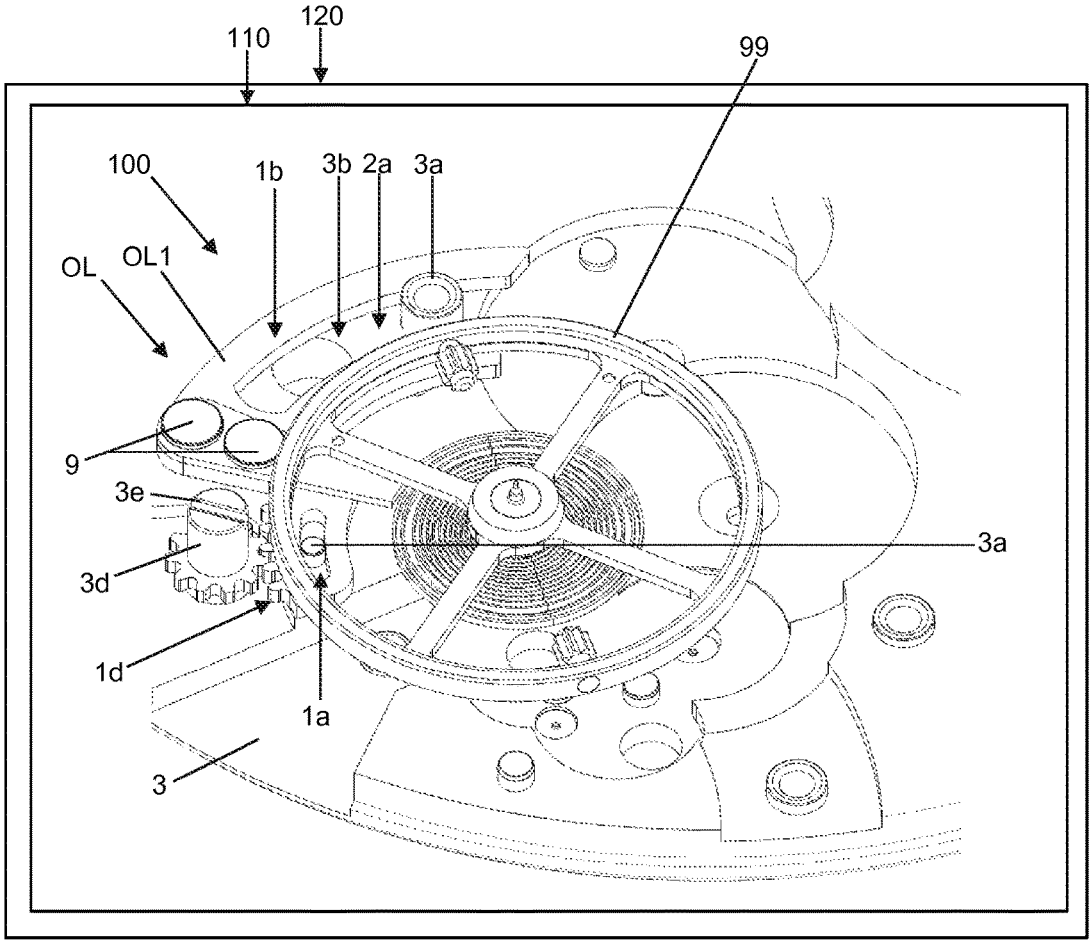
FIGS. 1 to 6 represent by way of example a first embodiment of a horology piece including a first embodiment of a system according to the invention.
Figure 2:
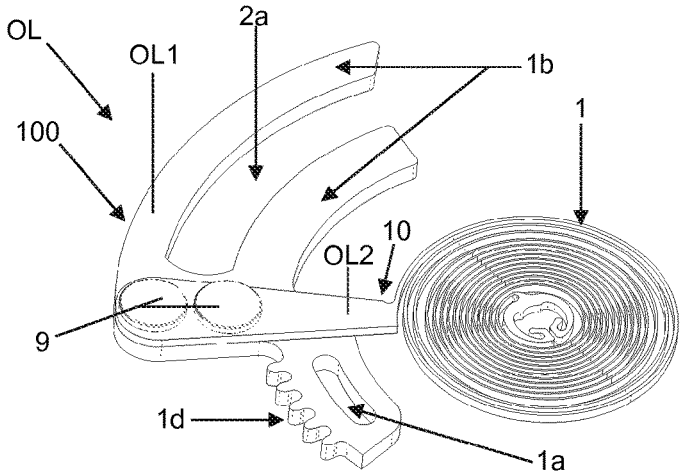
Figure 3:
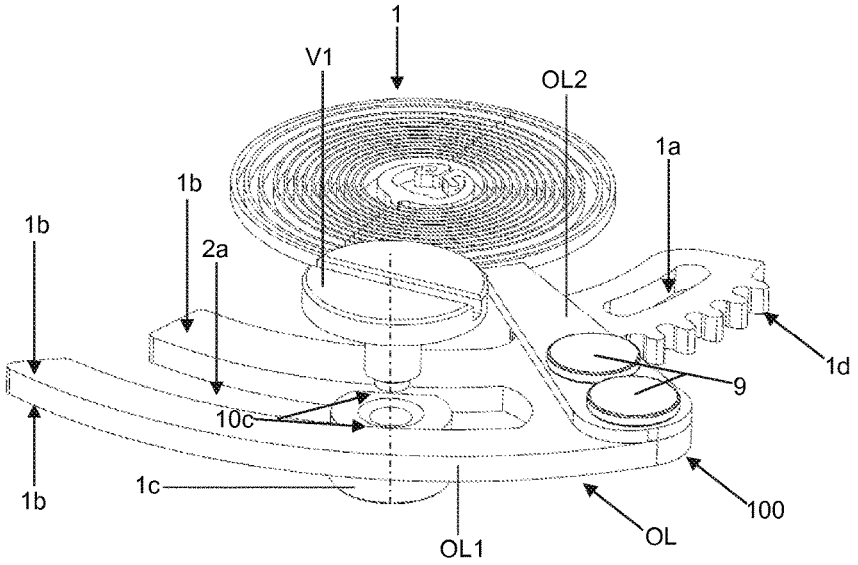

A first embodiment of a horology piece 120, in particular a wristwatch, is described hereinafter with reference to FIGS. 1 to 6. The horology piece comprises a horology movement 110. This horology movement comprises a balance spring system 100.

The system comprises:

- a balance spring 1;
- a movement blank 3;
- a first element 1*c* for indexing the position, in particular the angular position, of an outer end 10 of the balance spring relative to the blank 3, in particular a first indexing element 1*c* which is designed to cooperate with a second indexing element 3*c* provided on the blank 3; and
- a unit OL for connection of the outer end 10 of the balance spring to the blank 3, the first indexing element 1*c* being designed such as to be displaceable, in particular displaceable in rotation, relative to the connection unit.

Preferably, the first indexing element 1*c* comprises a shaft which is fitted on the connection unit. In particular, the first indexing element can comprise or be a screw foot 1*c* which is fitted on the connection unit OL. Advantageously, the first indexing element is designed to cooperate with a second indexing element 3*c* provided on the blank. In particular, the second indexing element can be a bore 3*c* provided in the blank. Thus, by means of the indexing element, the angular position of the spring relative to the frame of the movement is maintained if the oscillator is dismantled. The system can comprise a first element V1 for immobilization of the connection unit OL relative to the first indexing element 1*c*.

Indexing element means any element which can memorize a position, in particular an angular position, of a balance spring relative to a blank.

In the first embodiment, the spring 1 of the oscillator is connected to a balance, in particular in a habitual manner by means of a collet. The connection unit OL comprises a first part or a first connection unit body OL1 and a second part or a second connection unit body OL2. For example, the second connection unit part OL2 is produced integrally with the outer end 10 of the spring or is in a single piece with the spring. The first part of the connection unit OL1 is for example secured or added onto the second part of the connection unit OL2, in particular by interposition of pins or rivets 9. For this purpose, the first and second parts comprise for example holes which are designed to receive the pins or rivets. The second part of the unit OL2 is specifically designed to constitute an interface between the body of the spring produced from a first material, for example silicon, and the first part of the connection unit OL1, produced from a second material, for example NiP.

Alternatively, the connection unit OL can be produced integrally with the outer end 10 of the balance spring 1 or be in a single piece with the balance spring.

Preferably, the connection unit is at the median plane P of the balance spring. In particular, the connection unit can be between a first plane P1 and a second plane P2, the first plane and the second plane being symmetrical relative to the plane P, and spaced by a distance d. For example, d is smaller than 1.2 mm, or smaller than 1 mm, or smaller than 0.8 mm. Also preferably, the interface between the first part of the connection unit OL1 and the second part of the unit OL2 is situated at the median plane P of the balance spring. In particular, the interface between the first part of the connection unit OL1 and the second part of the unit OL2 can be between the first plane P1 and the second plane P2.

Preferably, the mechanical connection between the first part of the connection unit OL1 and the second part of the unit OL2 cannot be dismantled, i.e. it cannot be dismantled without damaging the mechanical connection and/or the first part of the connection unit and/or the second part of the connection unit.

The first part of the connection unit OL1 comprises elements for guiding in rotation of the balance spring, in particular of the outer end of the balance spring. The guiding elements comprise oblong openings 1*a*, 2*a*, for example two grooves in the form of concentric arcs of circles. The oblong grooves can be provided with different radii. Advantageously, the center of rotation, or the center of the arcs of circles, coincides substantially with the center of the balance spring. The openings 1*a*, 2*a* are for example designed to cooperate with other guiding elements, such as positioning posts 3*a* added onto the blank 3, in particular onto the plate 3. Thus, the guiding elements also constitute elements for centering of the balance spring. Preferably, there are at least two openings 1*a*, 2*a* in order to ensure radial positioning of the balance spring which is as accurate as permitted by the production and assembly tolerances. Ideally, these guiding elements make it possible to maintain the initial form of the balance spring, without constraints or with minimal constraints, in the position of rest of the adjustment unit.

The system can comprise a second element 1*b*, in particular an immobilization surface 1*b*, for immobilization of the first part of the connection unit relative to the blank 3 or of the outer end 10 of the balance spring relative to the blank 3, in particular a second immobilization element 1*b*, particularly an immobilization surface 1*b*, which is designed to cooperate with at least a third immobilization element 3*b*, particularly an immobilization surface 3*b*, of the blank 3.

Figure 4:
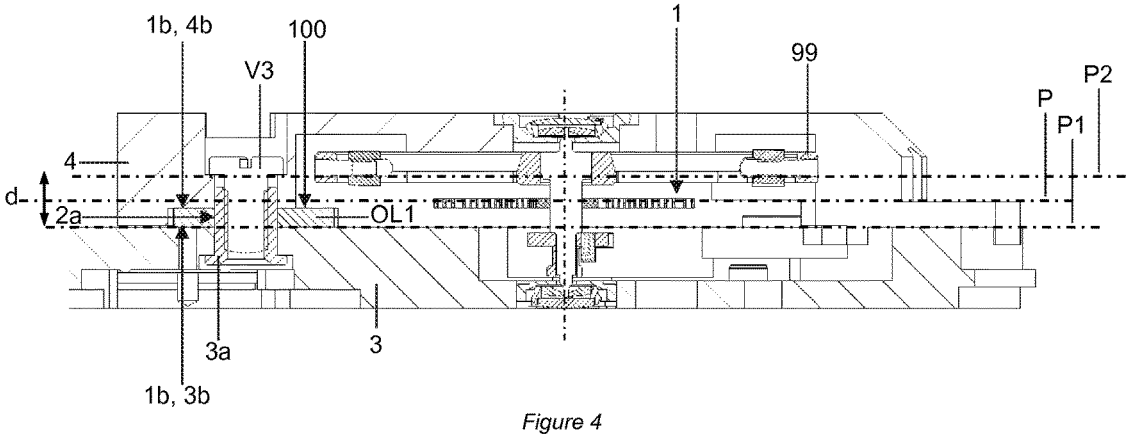

Advantageously, at least one post 3*a* is a screw foot. The latter preferably cooperates with the third immobilization element. The screw foot constitutes a means which permits securing or immobilization of the balance spring on the frame of the movement. In addition to its functions of guiding in rotation of the spring in cooperation with a groove 2*a*, the screw foot 3*a* can also be designed to participate in the positioning and securing of a balance bridge 4 on the plate 3, as represented in FIG. 4. The securing by screwing of this bridge 4 on the plate 3 induces the joining of the outer end of the balance spring with the frame of the movement. In fact, once the bridge 4 is fitted on the plate, support surfaces 1*b* of the first part of the connection unit OL1 are immobilized against respective support surfaces 3*b* and 4*b* of the plate 3 and of the balance bridge 4. The first part of the connection unit OL1 is then gripped between the plate and the bridge. The first part of the connection unit OL1 can preferably be made of a material which is more ductile than that of the body of the spring, in order to permit adequate resistance of the first part of the connection unit OL1 to the screwing forces.

The system comprises a first element 2*a* for guiding of the first indexing element 1*c* relative to the first part OL1 of the connection unit. In particular, the first guiding element comprises an oblong opening 2*a* which is designed to cooperate with a second guiding element 10*c*, such as a flattened part or two flattened parts provided on the screw foot 1*c*. The first indexing element is advantageously provided with a geometry which is substantially complementary to that of the oblong cut-out 2*a*, for example a geometry which includes for example one or two flattened parts 10*c*. These flattened parts can be flat. Alternatively, one or more flattened parts 10*c* need not be completely flat, but can have convexity or concavity which is complementary to that of the opening edge with which the flattened part must cooperate. In the first embodiment, the first element 2*a* for guiding of the first indexing element 1*c* relative to the first part OL1 of the connection unit is an element for guiding in rotation of the balance spring, in particular the outer end of the balance spring.

Figure 5:
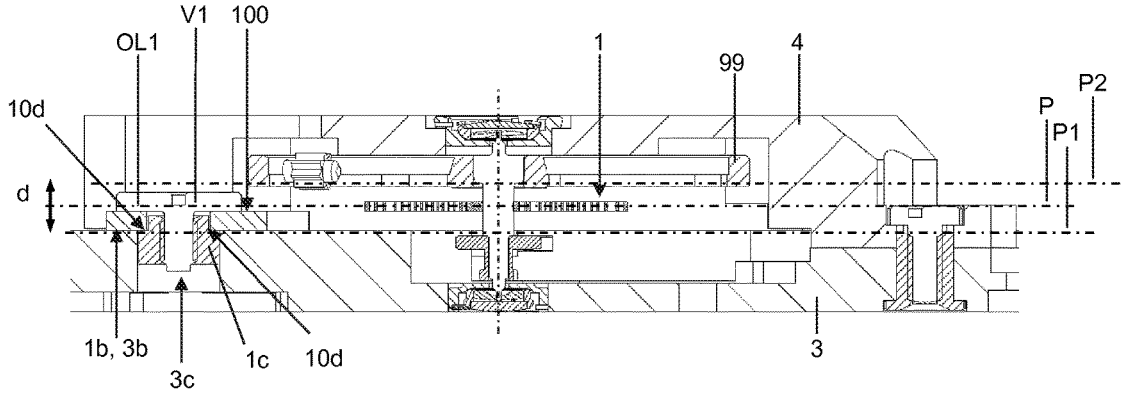

The system can comprise a first element V1 for immobilization of the connection unit OL relative to the first indexing element 1*c*. Thus, the first indexing element can be joined with, or secured on, the first part of the connection unit OL1 by means of the first immobilization element V1. The first immobilization element can be a screw V1. In order to carry out the immobilization or securing, the first part of the connection unit can be clamped between the head of the screw V1 and one or more shoulders 10*d* provided at the lower ends of the flattened part(s), as represented in FIG. 5.

When the spring is fitted on the movement, the screw foot 1*c*, which is joined with, or secured on, the spring, and in particular is secured on the first part of the connection unit OL1, is designed to be inserted in the bore 3*c* in the plate 3. The cooperation of these elements guarantees angular positioning of the balance spring which is as accurate as permitted by the production and assembly tolerances.

Figure 6:
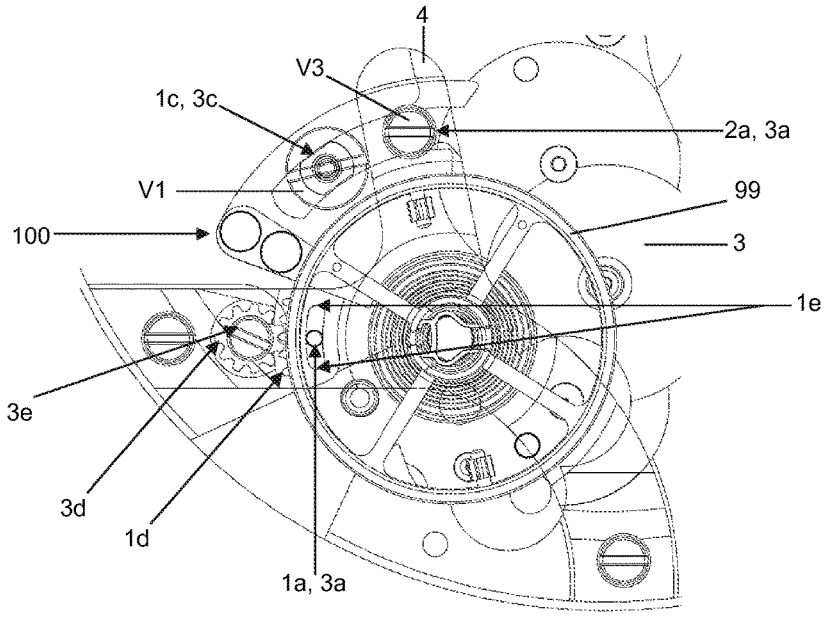

The adjusting operation is made possible as soon as the securing screw V1 of the screw foot 1*c* and a screw V3 of the screw foot 3*a* are unscrewed. In this configuration, the balance spring can be rotated, and in particular the outer end 10 of the balance spring can be rotated. This results in rotation of the balance, which permits the adjusting operation. In order to ensure this adjusting operation, the system advantageously comprises a first element 1*d* for adjustment of the position of the outer end 10 of the balance spring relative to the blank. This first adjustment element is designed to cooperate with a second adjustment element 3*d* in order to ensure the adjustment. As represented in FIG. 6, the first adjustment element can be a toothed sector 1*d*, and the second adjustment element can be a toothed nut 3*d* which is fitted such as to be mobile in rotation on the blank, and in particular on the plate 3.

For example, the toothed sector 1*d* can be produced on the first part of the connection unit OL1. In particular, the sector can be provided on an arc which is concentric to the spring and to the balance. Thus, the toothed nut can engage with the toothed sector, such that rotation of the nut gives rise to rotation of the toothed sector, and consequently rotation of the spring. In order to permit the rotation of the nut, the latter preferably has a conformation for being driven by means of a tool, for example a slot 3*e* which permits driving of the nut by means of a screwdriver. Preferably, the adjustment nut 3*d* is fitted with friction on the blank 3, or cooperates with a friction spring 6, such that resistive torque opposes its rotation, and consequently opposes the rotation of the balance spring. The friction spring can comprise a spring blade which is designed to cooperate directly or indirectly with the toothed nut, such as to create friction torque which opposes the rotation of the toothed nut. This spring blade can be secured on the blank, and can be supported on a face of the nut. The spring blade can be pre-stressed in order to apply mechanical action permanently on the nut.

The definition of the toothing of the adjustment elements, as well as the selection of the value of the resistive torque, participate in the implementation of a device for fine displacement of the spring relative to its securing support.

The system preferably comprises a first stop element, in particular a groove 1*a* or a pin which is designed to cooperate with a second stop element 3*a* provided on the plate, in particular a pin or a groove. Preferably, the range of angular rotation of the balance spring is defined by stops. For example, first stops can be constituted by the ends 1*e* of the oblong cut-outs 1*a*, which are designed to cooperate with second stops, for example one or more posts 3*a*. In the first embodiment, a single cut-out 1*a* forms the first stops 1*e*. This range of angular rotation can for example be between 20° and 40°.

Figure 7:
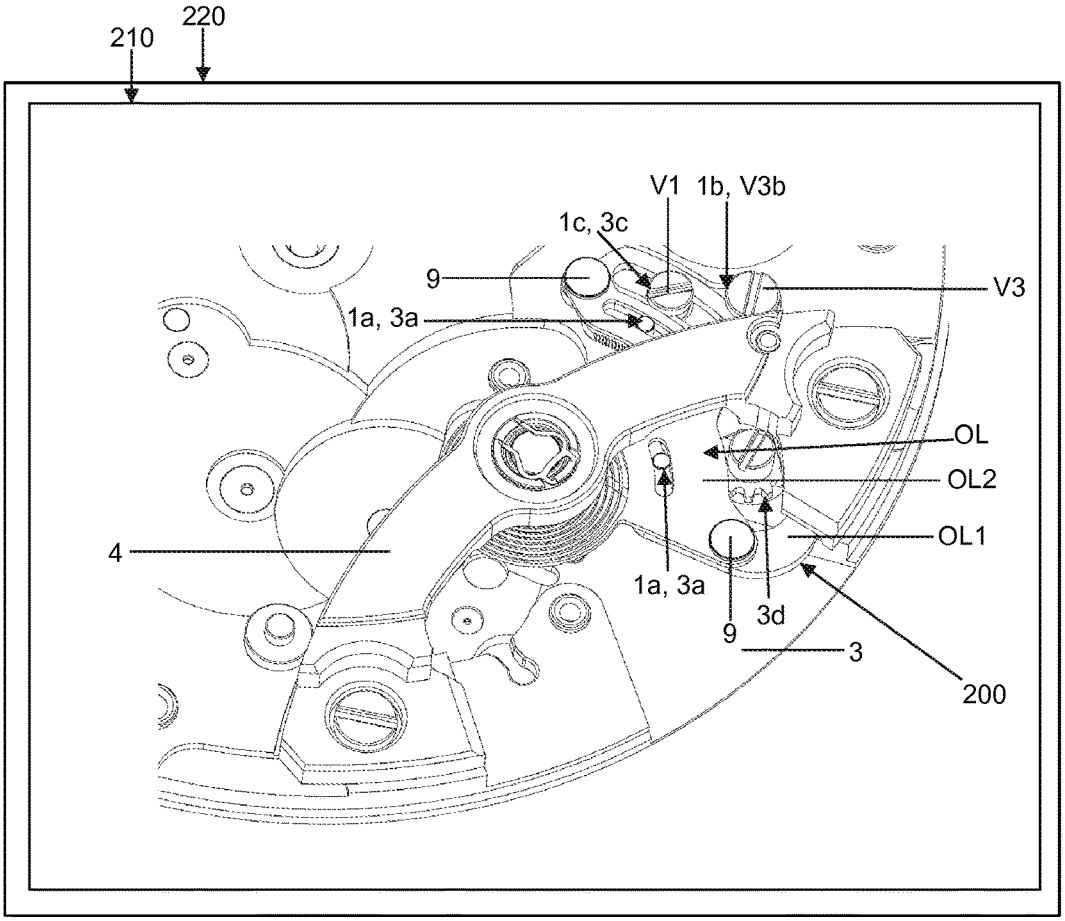
FIGS. 7 to 9 represent by way of example a second embodiment of a horology piece including a second embodiment of a system according to the invention.
Figure 8:
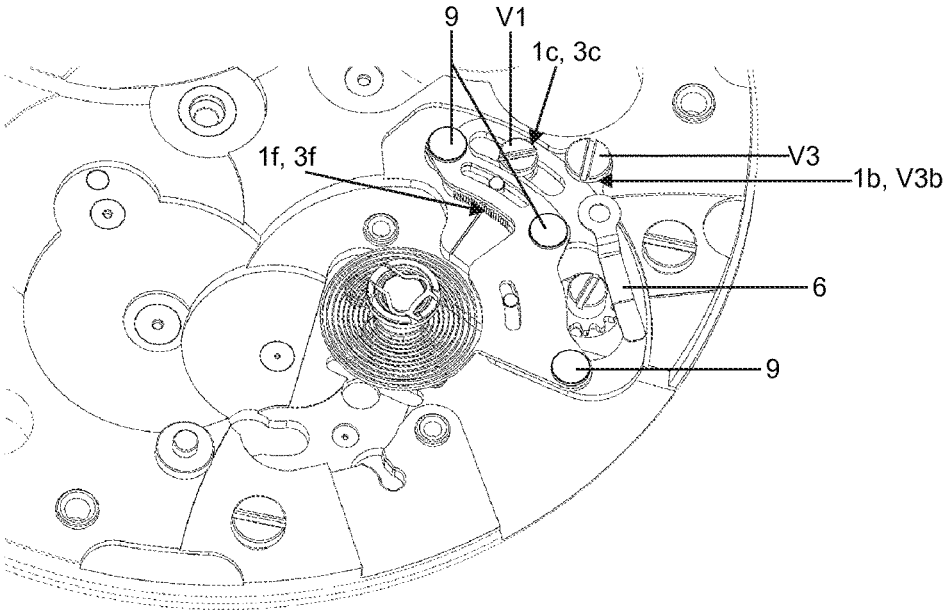
Figure 9:
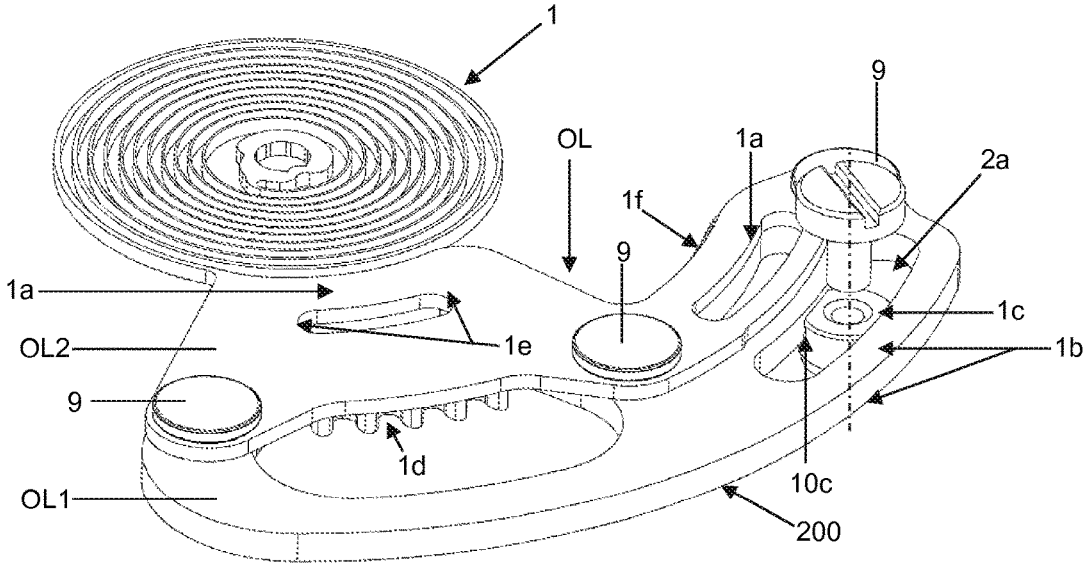

A second embodiment of a horology piece 220, in particular a wristwatch, is described hereinafter with reference to FIGS. 7 to 9. The horology piece comprises a horology movement 210. This horology movement comprises a balance spring system 200.

The second embodiment differs from the first embodiment mainly in that functions are distributed between the first and second parts of the connection unit OL1, OL2. In fact, in the first embodiment the functions (guiding, immobilization, indexing, regulation, stop, adjustment) are concentrated on the first part of the connection unit.

In the second embodiment, the guiding elements 1*a* can for example be formed on the second part of the connection unit OL2 which is produced integrally with the body of the spring. A solution of this type makes it possible to minimize the chain of tolerances, and thus ensure particularly accurate radial positioning of the balance spring.

In this second embodiment, an oblong cut-out 10*a* is especially dedicated to the implementation of the elements 1*c* for indexing of the angular position of the spring. Their functioning is identical to that of the elements previously described, the screw foot 1*c* being designed to be accommodated in a bore 3*c* provided in the plate 3. FIGS. 8 and 9 represent the spring assembled on the movement. This assembly is distinguished from that of the first embodiment in that the spring is secured by a screw V3 fitted directly on the plate 3, which does not have any effect on the balance bridge 4. The support surfaces 1*b* of the first part of the connection unit OL1 are in this case immobilized against respective support surfaces 3*b* and V3*b* of the plate 3 and the head of the screw V3. Thus, the adjusting operation is made possible independently of the elements for securing the balance bridge on the plate, by means of the unscrewing of the screw V3 and the screw V1 of the screw foot 1*c*.

As previously described, adjustment or drive elements 1*d* can be supported by the first part of the connection unit OL1. These elements are in the form of toothing 1*d* which can be driven by the toothing of an adjustment nut 3*d* fitted such as to pivot on the plate 3. The friction torque which is designed to oppose the rotation of the balance spring is in this case ensured by a spring 6 which is added on below the balance bridge, and is designed to act against a support surface 1*b* of the first part of the connection unit OL1. Thus, friction torque which opposes the rotation of the toothed nut indirectly is created.

Alternatively, the spring can be secured relative to the plate by friction, in particular by friction caused by the friction spring. Thus, the spring can be retained on the blank solely by a friction force induced by a support force. Thus, the spring can be secured independently of any securing screw.

The system can comprise a first adjusting-mark 1*f* for the position of the outer end of the balance spring relative to the blank, in particular first toothing if or a first adjusting-mark which is designed to cooperate respectively with a second adjusting-mark 3*f* provided on the blank or second toothing provided on the blank. Elements for adjustment or acknowledgement of the angular indexing of the balance spring are in this case in the form of micro-toothing 1*f* formed on the first part of the connection unit OL1, and designed to cooperate with a visual adjusting-mark 3*f* provided on the plate.

It will be appreciated that the various functions previously described can be distributed on the first and second parts of the connection unit to suit persons skilled in the art, according to the constraints of construction and of the environment of the adjustment unit. In other words, certain functions can be supported equally well by the first part of the connection unit and by the second part of the connection unit.

Some or all of the other characteristics of the second embodiment which have not been previously described can be identical to the equivalent characteristics of the first embodiment.

In a third embodiment (not represented), the first and second parts of the connection unit OL1 and OL2 can be combined, such that a single connection unit OL which is produced integrally with the body of the spring supports all of the functions. For a spring which is made of a fragile material such as silicon, the support surfaces 1*b* can for example be hardened by a localized coating, such as to withstand the axial forces, in particular the screwing forces.

In the various embodiments, the blank is preferably a plate.

Advantageously, in the various embodiments, at least one connection unit, which is or is not produced integrally with the outer end of the balance spring comprises elements for displacement in rotation of the balance spring relative to its support, such that it is possible to adjust the angular position of the balance spring relative to its support. These displacement elements are advantageously combined with elements for indexing of the angular position of the spring relative to the frame. These displacement elements can also be combined with elements for fine adjustment of the angular position of the spring relative to the frame.

Advantageously, a design of this type makes it possible to implement a system for putting an oscillator into beat, the balance spring of which is secured on the movement by one or more blanks which cannot be displaced relative to the frame.

Advantageously, the system permits rotation of a balance spring relative to its securing support, such that the adjusting operation can be carried out directly by rotation of the spring, and not by rotation of its securing support. A solution of this type can be particularly advantageous for an oscillator, the spring of which is secured on a support which is not displaceable relative to the frame of the horology movement, for example one or more blanks such as a plate and/or a balance bridge. The system according to the invention has the advantage of permitting adjustment of the adjusting-mark which has the particular feature of being able to be maintained after dismantling of the oscillator from its support, thanks to the elements for indexing of the angular position of the balance spring. In addition, the system can make it possible to implement elements for fine adjustment of the adjusting-mark by means of adjustment elements supported by the balance spring system.

A system of this type is suitable for any type of horology escapement.

In the embodiments previously described, the outer end of the spring is secured on the frame of the movement by the plate and the balance bridge, or by the plate, independently of the balance bridge. These architectures make it possible in particular to reduce the axial size of the oscillator, and to simplify the system for adjustment of the axial clearance of the assembled balance.

In the embodiments of the horology movement, the movement comprises the movement blank, notably a plate 3, and a balance 99. Preferably, the balance spring system is placed between the balance and the plate. Eventually, an element of the balance spring system, for example a first indexing element 1*c*, like a screw foot, and/or a guiding element, like a post 3*a*, and/or an adjusting element, like a screw 3*d*, may be placed in the movement blank or may be partially placed in the movement blank.

Except in cases of technical or logical incompatibility, the various technical characteristics of the first, second and third embodiments can be combined.

The invention also relates to a balance spring system 100; 200 of a horology movement 110; 120, comprising:

a balance spring 1; and a unit OL for connection of the outer end 10 of the balance spring to a movement blank 3, the connection unit including a first element 1*d* for adjustment of the position of the outer end 10 of the balance spring relative to the blank, in particular a first adjustment element 1*d* which is designed to cooperate with a second adjustment element 3*d* provided on the blank.

According to the invention, the adjusting operation comprises the following steps:

releasing the first indexing element 1*c* relative to the connection unit OL;

displacing the connection unit OL;

securing the position of the first indexing element 1*c* relative to the connection unit OL.

The first indexing element is released for example by acting on the first element V1 for immobilization of the connection unit OL relative to the first indexing element 1*c*. This action consists for example of unscrewing the screw V1. The first indexing element can then be displaced relative to the connection unit and vice versa.

The first indexing element can be displaced by direct action of the watchmaker on the indexing element, or preferably by direct action of the watchmaker on the connection unit. Direct action also means action of the watchmaker by means of a tool. Alternatively, the first indexing element can be displaced by indirect action on the indexing element or preferably on the connection unit. In particular, this indirect action can be carried out via the first element 1*d* for adjustment of the position of the outer end 10 of the balance spring relative to the blank, in particular via the toothed nut 3*d* which is fitted such as to be mobile in rotation on the blank 3. Thus, the watchmaker can displace the first indexing element relative to the connection unit by acting by means of a tool on the toothed nut.

The first indexing element is secured for example by acting on the first element V1 for immobilization of the connection unit OL relative to the first indexing element 1*c*. This action consists for example of screwing the screw V1. The first indexing element can then no longer be displaced.

Optionally, before or after the release of the first indexing element, it is possible to release the surface for immobilization of the connection unit relative to the surface for immobilization of the blank. The immobilization surface is released for example by acting on the screw V3 of the screw foot 3*a*. This action consists for example of unscrewing the screw V3. The unit can then be displaced relative to the blank.

Optionally, before or after the securing of the first indexing element, it is possible to secure the surface for immobilization of the connection unit relative to the surface for immobilization of the blank. The immobilization surface is secured for example by acting on the screw V3 of the screw foot 3*a*. This action consists for example of screwing the screw V3. The unit is then immobilized relative to the blank.

Throughout this document, the terms "spring" and "balance spring" are used without distinction to designate the same element.

Throughout this document, an "adjusting operation" is an operation putting a horology piece or an oscillator or a movement into beat.

In this document the ordinal numerical adjectives "first", "second", "third" and "fourth" have a distinctive meaning. They are used to distinguish the elements from one another.

Preferably, the present invention excludes the securing of the outer end of the balance spring by means of a stud or by means of an elastic securing mechanism cooperating with a stud for gripping the balance spring.

The invention claimed is:

1. A balance spring system of a horology movement, comprising:

a balance spring;

a movement blank;

a first element for indexing a position of an outer end of the balance spring relative to the movement blank; and a unit for connection of the outer end of the balance spring to the movement blank, the first indexing element being designed so as to be displaceable relative to the connection unit, wherein the position of the balance spring relative to the blank is memorized even if the balance spring system is dismantled by disassembling the balance spring from the movement blank.

2. The system as claimed in claim 1, wherein the connection unit is at a median plane of the balance spring, wherein the connection unit is between a first plane and a second plane, the first plane and the second plane being symmetrical relative to the median plane, and spaced by a distance which is smaller than 1.2 mm.

3. The system as claimed in claim 2, wherein the first plane and the second plane are spaced by a distance which is smaller than 0.8 mm.

4. The system as claimed in claim 1, wherein the first indexing element comprises a shaft which is fitted on the connection unit, the connection unit being designed to cooperate with a bore provided in the blank.

5. The system as claimed in claim 1, comprising a first element for immobilization of the connection unit relative to the first indexing element.

6. The system as claimed in claim 1, comprising a first element for guiding of the first indexing element.

7. The system as claimed in claim 1, comprising a first element for adjustment of the position of the outer end of the balance spring relative to the blank.

8. The system as claimed in claim 7, wherein a friction element is designed to cooperate directly or indirectly with the second adjustment element, so as to create friction torque which opposes the rotation of the second adjustment element.

9. The system as claimed in claim 1, comprising a third element for guiding of the system in rotation relative to the blank.

10. The system as claimed in claim 1, comprising a second element for immobilization of the connection unit relative to the blank or of an outer end of the balance spring relative to the blank.

11. The system as claimed in claim 1, comprising a first adjusting-mark for a position of an outer end of the balance spring relative to the blank.

12. The system as claimed in claim 1, wherein the blank is a plate.

13. The system as claimed in claim 1, wherein the connection unit is produced integrally with an outer end of the balance spring or is in a single piece with the balance spring.

14. The system as claimed in claim 1, wherein the connection unit comprises a first body and a second body produced integrally with the outer end of the balance spring or in a single piece with the balance spring, the first body being permanently secured on the second body.

15. The system as claimed in claim 14, wherein an interface between the first body and the second body is at a median plane of the balance spring, wherein the interface between the first body and the second body is between a first plane and a second plane, the first plane and the second plane being symmetrical relative to the median plane, and spaced by a distance which is smaller than 1.2 mm.

16. A horology movement comprising a balance spring system as claimed in claim 1.

17. The horology movement as claimed in claim 16, wherein the movement comprises a balance, the balance spring being connected between the balance and the movement blank.

18. A horology piece comprising a movement as claimed in claim 16.

19. A method for putting a horology movement as claimed in claim 16 into beat, wherein the method comprises:

releasing the first indexing element relative to the connection unit;

displacing the connection unit; and securing the position of the first indexing element relative to the connection unit.

20. The system as claimed in claim 1, wherein the first indexing element is designed to cooperate with a second indexing element provided on the blank, and to be displaceable in rotation relative to the connection unit.

21. The system as claimed in claim 1, wherein the first element indexes an angular position of the outer end of the balance spring relative to the blank with respect to an axis perpendicular to a median plane of the balance spring.

* * * * *